US005484155A

United States Patent [19]

Yamawaki et al.

[11] Patent Number: 5,484,155

[45] Date of Patent: Jan. 16, 1996

[54] GOLF CLUB HEAD

[75] Inventors: Koichi Yamawaki, Chiba, Japan; Franck Dumontier, Vista; Mike Peters, San Diego, both of Calif.; Jean-Marc Guibaud, Annecy, France

[73] Assignee: Taylor Made Golf Company, Inc., Carlsbad, Calif.

[21] Appl. No.: 322,482

[22] Filed: Oct. 14, 1994

[30] Foreign Application Priority Data

Nov. 12, 1993 [FR] France ..... 93.13680
Jan. 17, 1994 [JP] Japan ..... 77/1994 U

[51] Int. Cl.[6] ..... A63B 53/04

[52] U.S. Cl. ..... 273/164.1; 273/167 A; 273/167 J

[58] Field of Search ..... 273/167 R, 77 R, 273/164.1, 164.2, 162 R, 163 R, 187.4, 186.4, 187.6, 186.2, 167 D, 167 A, 167 J

[56] References Cited

U.S. PATENT DOCUMENTS

| | | | |
|---|---|---|---|
| D. 307,783 | 5/1990 | Iinuma | D21/214 |
| D. 310,254 | 8/1990 | Take et al. | D21/214 |
| D. 318,087 | 7/1991 | Helmstetter | D21/214 |
| D. 341,177 | 11/1993 | Yamada | D21/214 |
| D. 351,441 | 10/1994 | Iinuma et al. | D21/214 |
| 1,402,537 | 1/1922 | Reach | 273/164.1 |
| 1,619,566 | 3/1927 | Crankshaw . | |
| 1,660,126 | 2/1928 | Heeter | 273/164.1 |
| 1,868,286 | 7/1932 | Grieve . | |
| 2,041,676 | 5/1936 | Gallagher | 273/77 |
| 2,934,347 | 4/1960 | Siniscalchi | 273/164.1 |
| 2,954,231 | 9/1960 | Macintyre | 273/164.1 |
| 4,128,244 | 12/1978 | Duclos | 273/164.1 |
| 4,527,799 | 7/1985 | Solheim | 273/164.1 |
| 4,960,279 | 10/1990 | Harris | 273/164.1 |
| 5,067,715 | 11/1991 | Schmidt et al. | 273/167 F |
| 5,154,423 | 10/1992 | Antonious | 273/167 A |
| 5,163,682 | 11/1992 | Schmidt et al. | 273/167 J |
| 5,180,166 | 1/1993 | Schmidt et al. | 273/167 F |
| 5,240,252 | 8/1993 | Schmidt et al. | 273/167 A |
| 5,280,923 | 1/1994 | Lu | 273/167 H |
| 5,301,945 | 4/1994 | Schmidt et al. | 273/167 A |
| 5,318,300 | 6/1994 | Schmidt et al. | 273/167 J |

FOREIGN PATENT DOCUMENTS 0532876 3/1993 European Pat. Off. .

OTHER PUBLICATIONS

Spalding Catalog "Pro Golf", 1984, p. 20, "Dynamiter" metal wood.

Spalding Catalog "Pro Golf", 1985, p. 21, "Dynamiter" metal wood.

*Primary Examiner*—Sebastiano Passaniti

*Attorney, Agent, or Firm*—Sandler, Greenblum, & Bernstein

[57] ABSTRACT

The invention relates to a metal head for a golf club of the "wood" type, which is provided with a body, and optionally a hosel, the body including one part that is sandblasted or covered with paint, and one part that is polished. The polished part corresponds at least to the surface subjected principally to friction with the ground, and the other part corresponds at least to the surface of the body visible to the golfer when he or she addresses the ball, except for a lower polished zone of the front face, which extends from the striking edge and whose boundary with the upper sandblasted or paint-covered zone forms a substantially horizontal line of demarcation separating the face, when the head rests on the ground for the address of the ball.

9 Claims, 3 Drawing Sheets

FIG. 1
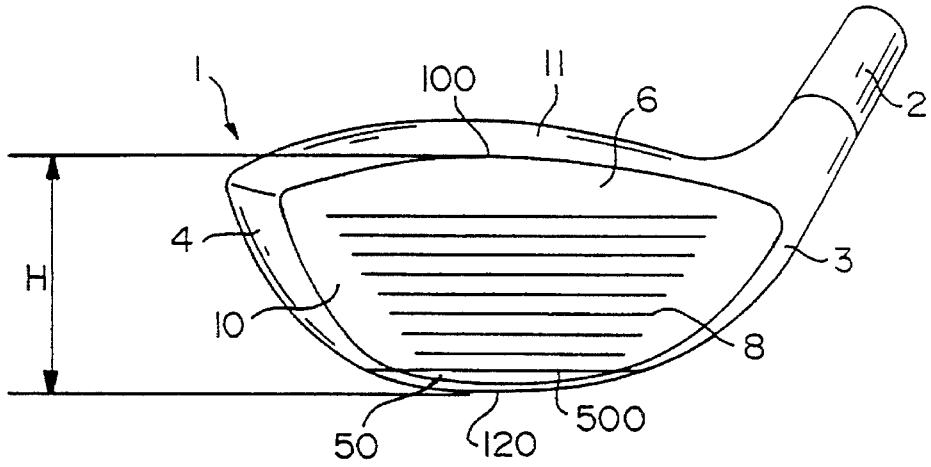
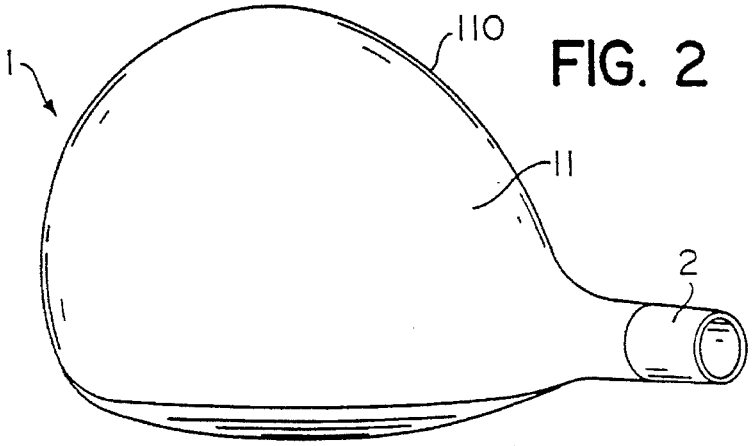
FIG. 2
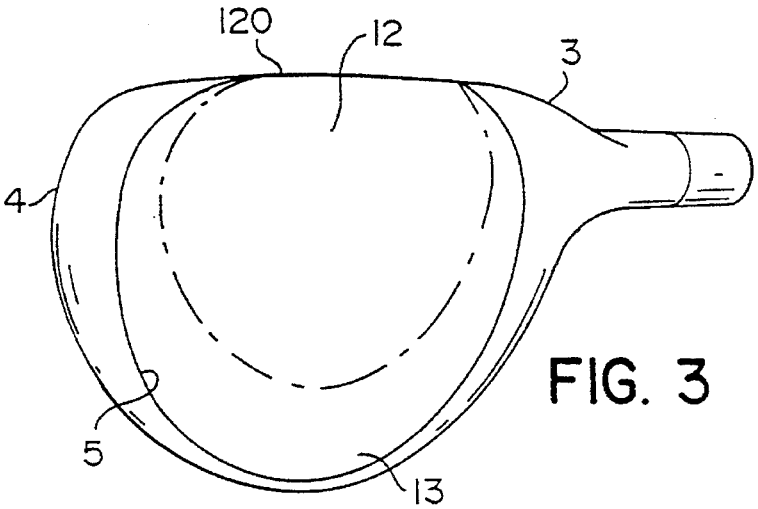
FIG. 3

GOLF CLUB HEAD

BACKGROUND OF THE INVENTION

1. Field of the Invention

The present invention relates to a metal golf club head, and more particularly to heads of the type known as "woods".

2. Description of Background and Other Information

Golfers attach increasing importance to the aesthetic appearance of their equipment and to how its appearance changes over time. The degradation in the external appearance of a golf club head after several rounds have been played may become bothersome and irritating to the golfer in a way that directly affects his or her performance in the game.

Most club heads degrade rapidly after several hours of use because they are subjected to repeated phenomena of friction with the ground. This degradation primarily involves heads covered with metallized or non-metallized paint, but also those that undergo a specific surface treatment with poor resistance to scratching, such as sandblasting.

SUMMARY OF THE INVENTION

It is therefore an object of the present invention to provide a satisfactory solution to the aforementioned problem of durability of the aesthetic appearance of a painted or sandblasted head.

An additional object of the invention is to improve the orientation of the head, when the ball is addressed, perpendicular to the direction of the intended trajectory, while deterring the golfer from using the upper curvilinear edge of the head as a reference mark for positioning purposes.

To these ends, and taking into account the techniques already known from the prior art, the invention includes a metal head for a golf club of the "wood" type, which is provided with a body, and optionally a hosel, the body including one part that is sandblasted or covered with paint, and one part that is polished. The polished part corresponds at least to the surface subjected principally to friction with the ground, and the other part corresponds at least to the surface of the body visible to the golfer when he or she addresses the ball, except for a lower polished zone of the front face, which extends from the striking edge and whose boundary with the upper sandblasted or paint-covered zone forms a substantially horizontal line of demarcation separating the face, when the head rests on the ground for the address of the ball.

By means of the aforementioned embodiment, the surface that is principally subjected to friction, which includes a part of the lower face above the striking edge of the head, undergoes less degradation over time because of the polishing treatment of the surface, which is resistant to scratching and to repeated friction on any type of ground.

Conversely, the part of the club head that the golfer can see as he or she puts the club in place and prepares to hit the ball, is sandblasted or completely covered with paint, thereby lending the head a satisfactory aesthetic appearance that pleases the golfer and gives the golfer confidence before he or she begins playing.

In addition, the fact that the upper edge is not a line of transition between a painted or sandblasted part and a polished part, as is generally the case for the heads in the prior art, makes it possible to prevent drawing the golfer's vision to this edge and prevents numerous errors in orienting the head with respect to the ball. In fact, the golfer's glance is more naturally drawn to the area of the horizontal transition line demarcating the upper zone from the lower zone of the driving face. This line is easier for the golfer to place perpendicular to the direction of the chosen trajectory.

In accordance with another aspect of the invention, the horizontal line is located at a distance of between 0.1 and 0.30 times the face height (H). The height (H) is defined as the height measured between the highest point inscribed on the upper edge and the lowest point inscribed on the edge that constitutes the striking edge.

The surface of the polished zone of the face thus defined corresponds to that which is most frequently subjected to friction with the ground.

In a complementary aspect of the invention, the striking face includes a series of horizontal grooves, one of which forms the aforementioned line of horizontal demarcation. This line is preferably inscribed in the lowest groove of the series.

In another aspect of the invention, the part that is sandblasted or covered with paint is defined as including at least the aforementioned upper face zone and the upper, slightly convex face of the head. The polished part includes at least the aforementioned lower face zone, as well as the sole which corresponds to the part of the body in contact with the ground upon the address.

BRIEF DESCRIPTION OF THE DRAWINGS

The above and additional objects, characteristics, and advantages of the present invention will become apparent in the following detailed description of preferred embodiments, with reference to the accompanying drawings which are presented as non-limiting examples, in which:

FIG. 1 is a front elevation view of a golf club head according to the invention;

FIG. 2 is a top plan view of the club head of FIG. 1, as the golfer may observe it when addressing the ball;

FIG. 3 is a bottom plan view of the club head;

DETAILED DESCRIPTION OF PREFERRED EMBODIMENTS

Figure 4:
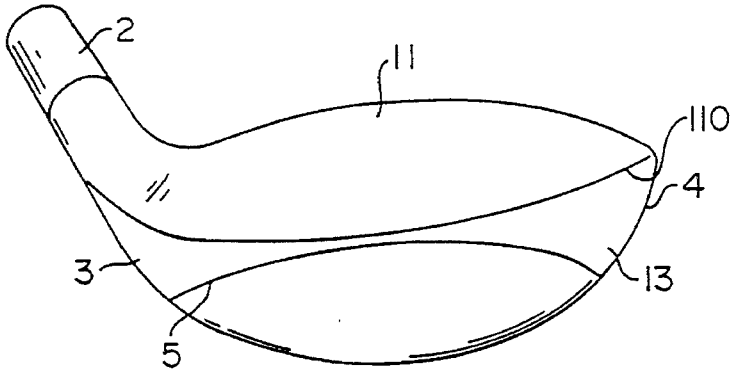
FIG. 4 is a rear elevation a view of the club head.
Figure 5:
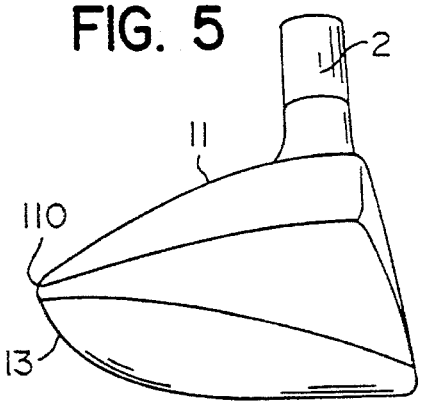
FIG. 5 is a right side elevation view of the club head.
Figure 6:
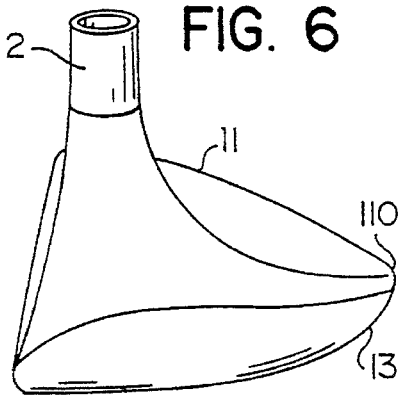
FIG. 6 is a left side elevation view of the club head.
Figure 7:
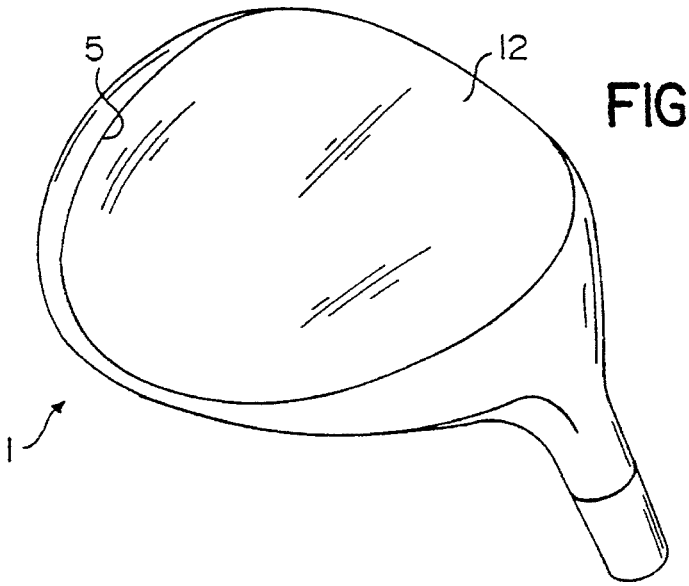
FIG. 7 is a perspective view of the bottom of the club head, viewed from the rear.

As shown in FIGS. 1–6, the metal head according to the invention has a body 1, which is extended on the side by a hosel 2 that is intended to be engaged by a shaft (not shown).

The body includes a driving face 10 of height H, an upper convex face 11, a lower face or sole 12 (bounded by dotted lines in FIG. 3) and a rear lateral incurved face 13, which extends from the heel 3 to the toe 4 of the club head. The aforementioned various parts can form more or less pronounced edges with one another or, conversely, can form radiating parts that make it more or less easy to determine the boundary between the various parts with precision. In any case, one can very precisely define an upper curvilinear edge 100, which defines the boundary between the front face 10 and the upper face 11. A lower edge or striking edge 120 can also be identified between the face 10 and the sole 12, as can an incurved edge 110 between the upper convex face 11 and the lateral incurved face 13.

The invention comprises the provision of two parts of distinct appearance, which include a different and suitably adapted surface covering. Of these parts, the one subjected to friction with the ground has a surface of polished metal, which is resistant to scratching. This part includes the sole 12 and partly projects over the laterally incurved surface 13 on the one hand and over a lower zone 50 of the front face 10 beyond the striking edge 120. The remaining part of the head body is covered with one or more layers of paint and is optionally varnished, lending an apparent uniformity of treatment when seen from above, by the golfer and by any other observer. Hence the upper surface 11 and the remaining surfaces of the front face 10 and lateral face 13 are treated this way within the bounds of the demarcation line 5. In the drawing, the painted or sandblasted zones are shaded and the polished zones are shown clear, i.e., in solid white.

One of the important features of the invention is that the boundary between the upper painted zone 6 and the lower polished zone 50 of the front face 10 represents a horizontal straight line 500 when the head rests on the ground when the ball is addressed. Thus, such a line is a prime visual reference mark to aid the golfer in placing the head correctly along an axis perpendicular to the direction of the chosen trajectory. The front driving face 10 preferably includes a series of horizontal grooves 8, as is known per se.

Another characteristic of the invention consists of providing that the lowest groove coincides with the line 500 demarcating the two zones defined above. Hence, marking out this line 500 at some depth presents any risk that it will blur over time.

It is understood that treating the visible part of the body with paint may be replaced by a sandblasting operation done on the metal surface. Such a treatment leads a distinctive appearance to the head with respect to the polished part. Nevertheless, the sandblasted part is not so resistant to scratching and friction as the polished part.

Figure 8:
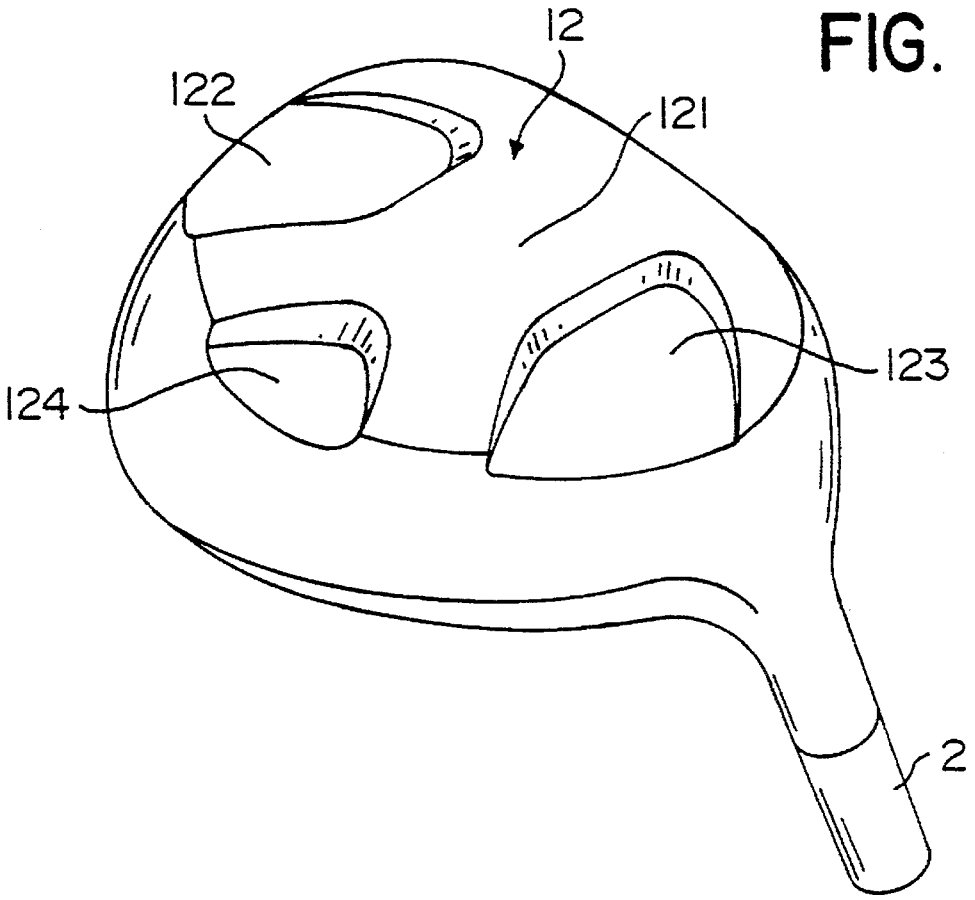
FIG. 8 is a rear perspective view of the bottom of the club head, according to a variation.
Figure 9:
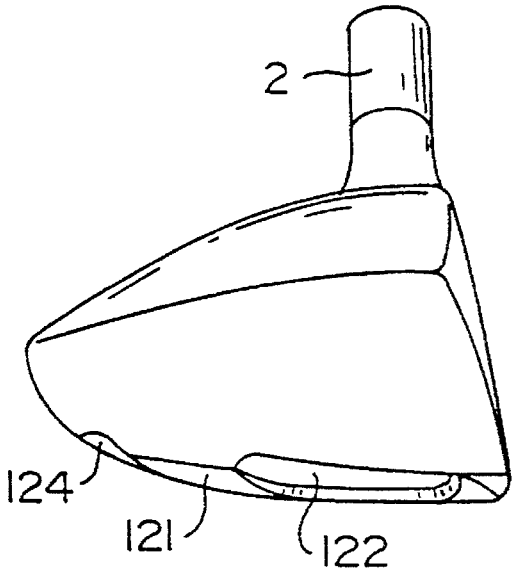
FIG. 9 is a right side elevation view of the club head of FIG. 8.

FIGS. 8 and 9 illustrate a variant of the invention. The head 12 has one part in high relief 121 and parts 122, 123, 124 below the level of the part in relief 121. In such a configuration, it will be appreciated that only the part 121 principally subjected to friction requires polishing, while the hollowed-out parts 122, 123, 124 can be treated by sandblasting or once again can be painted.

The instant application is at least partially based upon Japanese Utility Model Application No. 77/1994, filed on Jan. 17, 1994, the disclosure of which is hereby expressly incorporated by reference thereto in its entirety and the priority of which is hereby claimed. Further, the instant application is at least partially based upon French Patent Application No. 93.13680, filed on Nov. 12, 1993, the disclosure of which is also hereby expressly incorporated by reference thereto in its entirety and the priority of which is hereby claimed.

Finally, although the invention has been described with reference of particular means, materials and embodiments, it is to be understood that the invention is not limited to the particulars disclosed and extends to all equivalents within the scope of the claims.

What is claimed is:

1. A metal head for a golf club of the wood type, said head comprising:

a body and optionally a hosel, said body including a front face having a striking edge, said body further including one part that is sandblasted or covered with paint and one part that is polished, wherein the polished part corresponds at least to a surface of the body subjected principally to friction with the ground, and the sandblasted or paint-covered part corresponds at least to a surface of the body visible to the golfer when he addresses the ball, with the exception of a lower polished zone of the front face, which extends from the striking edge and which has a boundary with an upper sandblasted or paint-covered zone formed by a substantially horizontal line of demarcation extending across the front face, when the head rests on the ground when the ball is addressed.

2. The golf club head of claim 1, wherein the horizontal line is located at a distance above the striking edge of between 0.1 and 0.30 times the face height (H).

3. The golf club head of claim 1, wherein the front face includes a series of horizontal grooves, one of which forms said horizontal line demarcating the upper sandblasted or paint-covered zone of the front face from the lower polished zone of the front face.

4. The golf club head of claim 3, wherein the series of horizontal grooves comprise a lowest groove on the front face, wherein said horizontal line is inscribed in the lowest groove of the series.

5. The golf club head of claim 1, wherein the body further includes an upper, slightly convex face and wherein the part that is sandblasted or covered with paint includes at least said upper front face zone and the upper, slightly convex face.

6. The golf club head of claim 5, wherein the polished part includes at least said lower front face zone and a sole which corresponds to the part of the body in contact with the ground when the ball is addressed.

7. The golf club head of claim 6, wherein the polished part protrudes from a boundary of said sole in at least one portion of a lateral incurved face joining a heel to a toe of said head.

8. The golf club head of claim 1, wherein the polished part includes at least one part of a sole that is in relief, while parts below the level of the relief are painted or sandblasted.

9. The golf club head of claim 8, wherein the sole includes at least one median rib in relief, said median rib extending substantially perpendicularly from said striking edge.

* * * * *